US010638806B1

(12) United States Patent
Whittaker-McKinney

(10) Patent No.: US 10,638,806 B1
(45) Date of Patent: May 5, 2020

(54) CONVERTIBLE AND CUSTOMIZABLE GREETING CARD

(71) Applicant: Stephanie Whittaker-McKinney, Milwaukee, WI (US)

(72) Inventor: Stephanie Whittaker-McKinney, Milwaukee, WI (US)

( * ) Notice: Subject to any disclaimer, the term of this patent is extended or adjusted under 35 U.S.C. 154(b) by 169 days.

(21) Appl. No.: 15/225,129

(22) Filed: Aug. 1, 2016

(51) Int. Cl.

| | |
|---|---|
| ***A42B 1/20*** | (2006.01) |
| ***A42B 1/00*** | (2006.01) |
| ***A41G 1/00*** | (2006.01) |
| ***B42D 15/04*** | (2006.01) |

(52) U.S. Cl.
CPC ..... *A42B 1/206* (2013.01); *A41G 1/00* (2013.01); *A42B 1/004* (2013.01); *A42B 1/201* (2013.01); *A42B 1/208* (2013.01); *B42D 15/042* (2013.01)

(58) Field of Classification Search
CPC ..... B42D 15/042; A42B 1/208; A42B 1/206; A42B 1/201; A42B 1/006; A41G 1/00
See application file for complete search history.

(56) References Cited

U.S. PATENT DOCUMENTS

| | | | | | |
|---|---|---|---|---|---|
| 1,247,415 | A * | 11/1917 | Lattimore | A42B 1/208 | 2/195.7 |
| 1,631,210 | A * | 6/1927 | Johnson | A42B 1/208 | 2/12 |
| 2,410,158 | A * | 10/1946 | Gardner | A42B 1/208 | 2/209.3 |
| 2,594,906 | A * | 4/1952 | Gardner | A42B 1/208 | 2/171.01 |
| 2,974,434 | A | 3/1961 | Gibson | | |
| 3,362,028 | A * | 1/1968 | Leopardo | A42B 1/208 | 2/209.3 |
| 5,864,973 | A | 2/1999 | Cole | | |
| 2004/0117893 | A1* | 6/2004 | Ginsberg | A42B 1/208 | 2/200.3 |
| 2006/0015984 | A1* | 1/2006 | Liu | A42B 1/208 | 2/171 |
| 2008/0282447 | A1* | 11/2008 | Mulaw | A42B 1/208 | 2/172 |

FOREIGN PATENT DOCUMENTS

| | | | | |
|---|---|---|---|---|
| CA | 2428439 | A1 * | 3/2004 | A42B 1/02 |
| DE | 10149974 | A1 * | 5/2003 | A42B 1/208 |
| WO | WO 2006096941 | A1 * | 9/2006 | A42B 1/208 |

* cited by examiner

*Primary Examiner* — Shaun R Hurley
*Assistant Examiner* — Andrew Wayne Sutton
(74) *Attorney, Agent, or Firm* — Joseph T. Miotke; DeWitt LLP

(57) ABSTRACT

A convertible greeting card that can be converted from a greeting card into an accessory such as a hat. The convertible greeting card can optionally include a message and a decoration. The shape and geometry of the convertible greeting card are typically selected such that brims will extend in a direction generally orthogonal to a first surface of the card when the brim flaps are releasably affixed to one another. Decorations can be disposed on one or more of a first or second surface of the card. A message can also be disposed on a surface of the card.

10 Claims, 5 Drawing Sheets

CONVERTIBLE AND CUSTOMIZABLE GREETING CARD

CROSS-REFERENCES TO RELATED APPLICATIONS

Not Applicable

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

BACKGROUND OF THE INVENTION

The present invention relates to greeting cards, and more specifically to a greeting card that can be optionally converted into a hat.

BRIEF SUMMARY OF THE INVENTION

The demand for unique and customizable greeting cards continues to grow. In addition, the demand for specialized hats or other accessories to commemorate special occasions continues to grow. As one non-limiting example, a special hat or other accessory is typically worn by a person celebrating a special occasion such as a birthdate, anniversary, bachelorette party, or other milestone. In addition, on such occasions, guests typically present the person of honor with a greeting card to commemorate the occasion. In addition, stylized headwear such as a "fascinator" type hat continues to grow in popularity. Such fascinator hats and other headwear can be customized for the occasion and configured in a wide variety of styles. Customized headwear such as fascinator hats are one example of a special hat or other accessory worn by the person of honor at a celebration. Such customized headwear can likewise be worn on other occasions as desired.

In one aspect, the present invention is a customizable greeting card that can be converted into a hat or other accessory to be worn by a person. In another aspect, the present invention is a greeting card that can be converted into a hat resembling a fascinator type hat as well as other styles as desired.

DETAILED DESCRIPTION OF THE INVENTION

Figure 1:
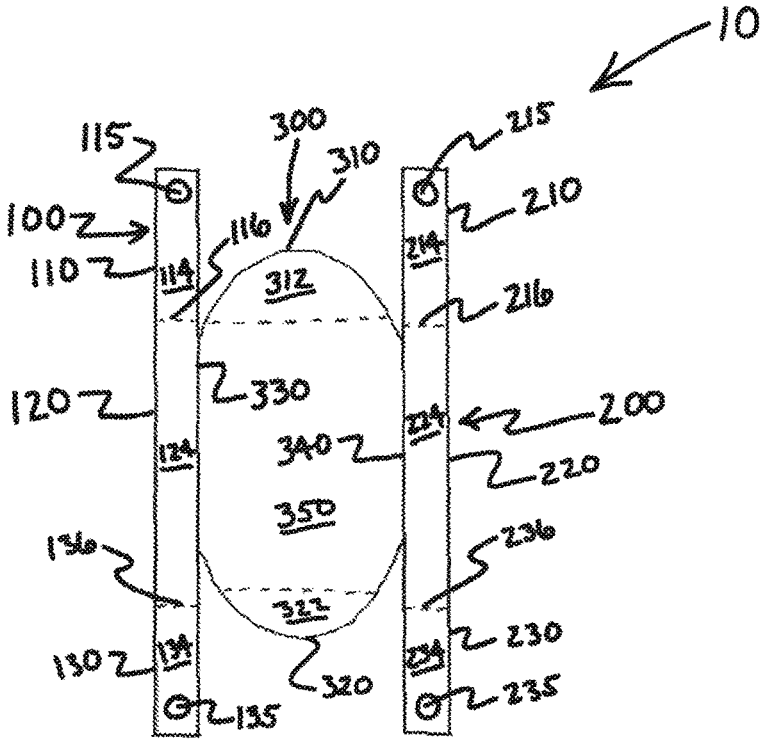
FIG. 1 is a top view of the base pattern according to one aspect of the invention.

Referring to FIG. 1, a base pattern 10 is shown. According to certain aspects of the invention, base pattern 10 can typically be converted into a greeting card 20 (shown in FIG. 6) and into an accessory 30 (shown in FIGS. 9 and 10) by folding actions as described herein. Base pattern 10 is typically constructed from cardboard suitable for use as a greeting card, but other suitable materials can be used. Such materials include cardstock, construction paper, stationary paper and felt paper. Any other material not inconsistent with the purpose of this invention can likewise be used for base pattern 10.

Still referring to FIG. 1, base pattern 10 typically comprises a central body 300, a first brim 100, and a second brim 200. Central body 300 typically comprises a first surface 350, a second surface 352 (shown in FIG. 6) located on the opposite side of central body 300 to surface 350, a first lid 310 having a first surface 312, and a second lid 320 having a first surface 322. First brim 100 is typically positioned proximate a first side 330 of central body 300. First brim 100 typically comprises a first brim flap 110, second brim flap 130, and central portion 120. First brim flap 110 typically comprises a first surface 114 and second surface 112 (shown in FIG. 3). Second brim flap 130 typically comprises a first surface 134 and second surface 132 (shown in FIG. 3). Central portion 120 typically comprises a first surface 124 and a second surface 122 (shown in FIG. 4).

Second brim 200 is typically positioned proximate a second side 340 of central body 300. Second brim 200 typically comprises a first brim flap 210, second brim flap 230, and central portion 220. First brim flap 210 typically comprises a first surface 214 and a second surface 212 (shown in FIG. 3). Second brim flap 230 typically comprises a first surface 234 and a second surface 232 (shown in FIG. 3). Central portion 220 typically comprises a first surface 224 and a second surface 222 (shown in FIG. 4).

Figure 2:
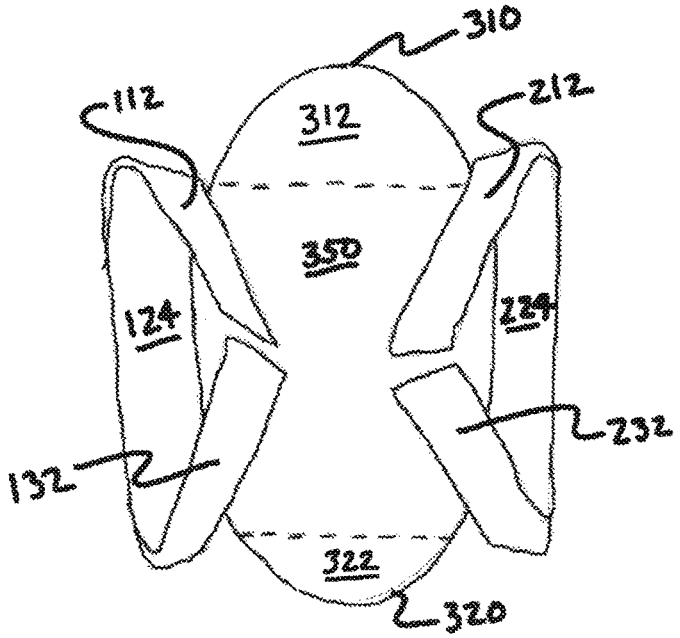
FIG. 2 is another top view of the base pattern according to one aspect of the invention.
Figure 3:
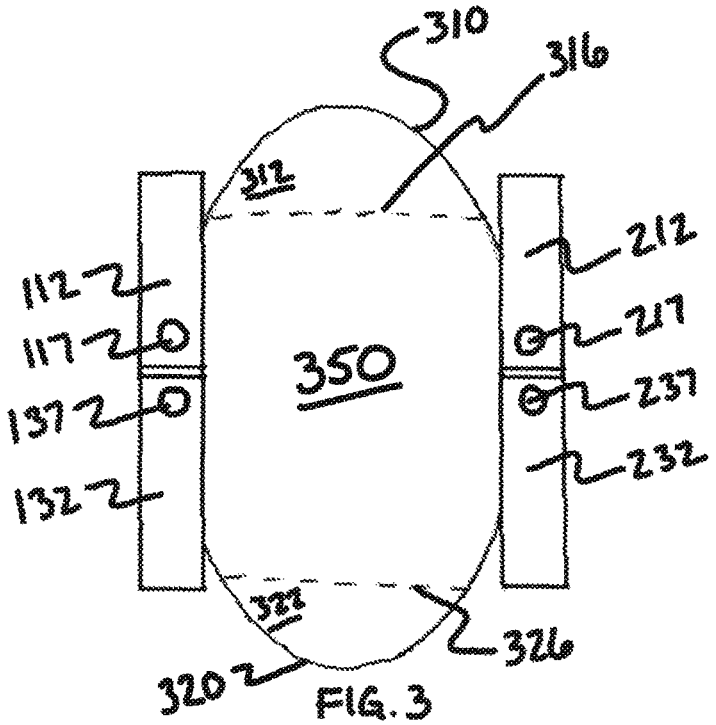
FIG. 3 is another top view of the base pattern according to one aspect of the invention.

Now referring to FIGS. 2, 3, 4, 5, and 6, an exemplary process by which base pattern 10 can typically be converted into a greeting card 20 is described. This process is by way of example only and does not limit application of the present invention. Referring to FIGS. 1, 2, and 3, first brim flap 110 and second brim flap 130 of first brim 100 are typically folded along fold lines 116 and 136 such that surfaces 114 and 134 are disposed proximate surface 124 of central portion 120. Likewise, first brim flap 210 and second brim flap 230 of second brim 200 are typically folded along fold lines 216 and 236 such that surfaces 214 and 234 are disposed proximate surface 224 of central portion 220.

Figure 4:
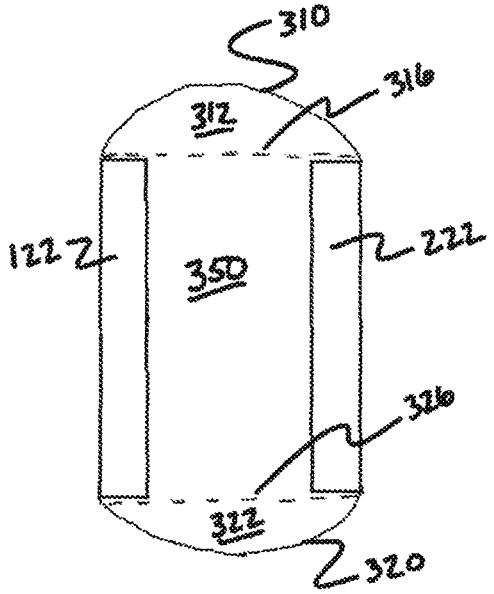
FIG. 4 is another top view of the base pattern according to one aspect of the invention.
Figure 5:
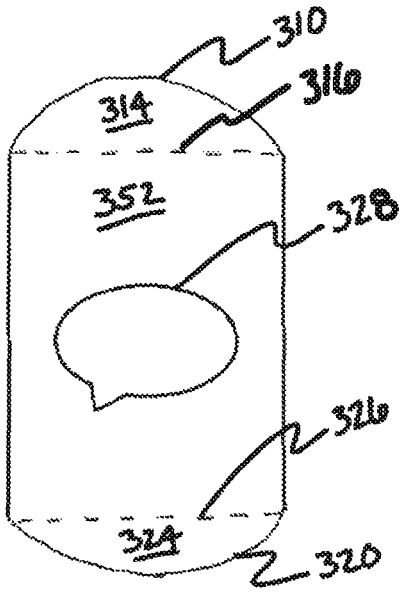
FIG. 5 is another top view of the base pattern according to one aspect of the invention.
Figure 6:
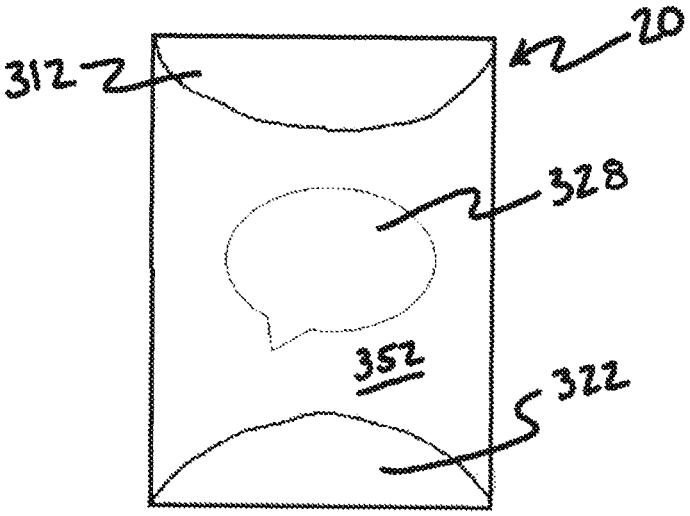
FIG. 6 is a top view of a card according one aspect of the invention.

Referring now to FIGS. 4 through 6, first lid 310 and second lid 320 are typically folded along fold lines 316 and 326 such that surfaces 314 and 324 are disposed proximate surface 352 (see FIG. 6). A greeting card message 328, or any other text, images, decoration or other information, is typically placed on surface.

Figure 7:
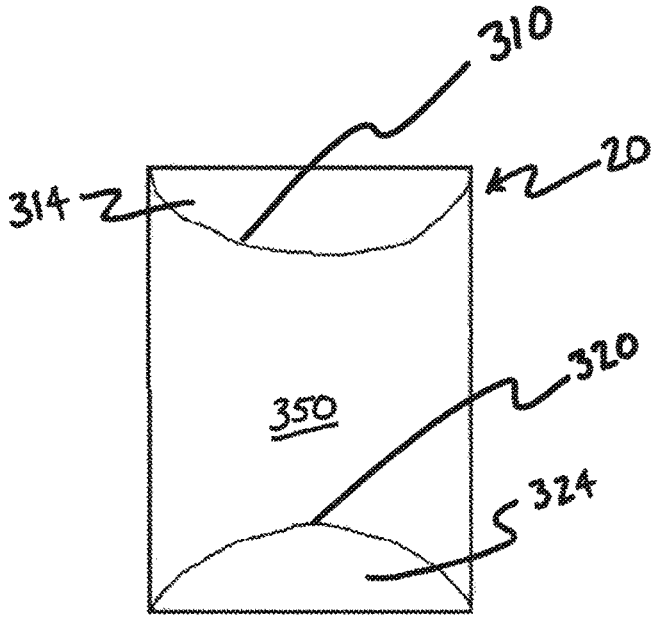
FIG. 7 is another top view of a card according one aspect of the invention.

Referring to FIG. 7, an alternate aspect of the greeting card 20 is shown. Here, first lid 310 and second lid 320 are typically folded along fold lines 316 and 326 such that surfaces 312 and 322 are disposed proximate surface 350

(see FIG. 7). A greeting card message 328, or any other text, images, decoration or other information, is typically placed on surface 352 at location 328.

Figure 8:
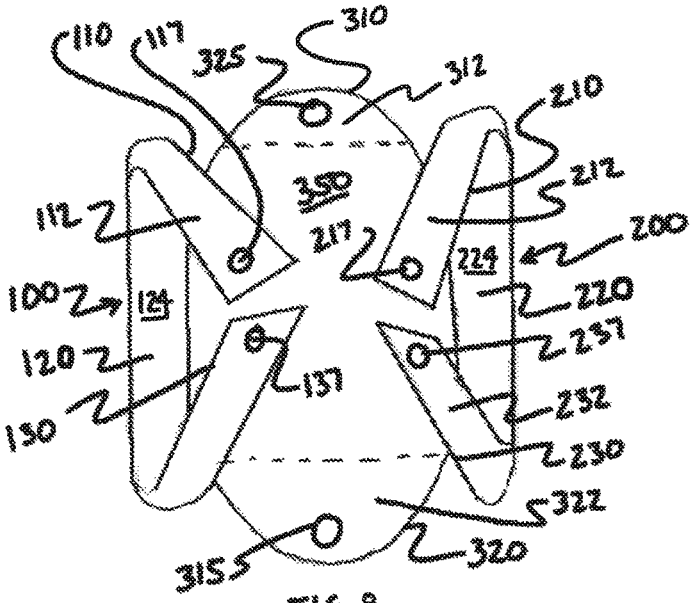
FIG. 8 is another top view of the base pattern according to one aspect of the invention.
Figure 9:
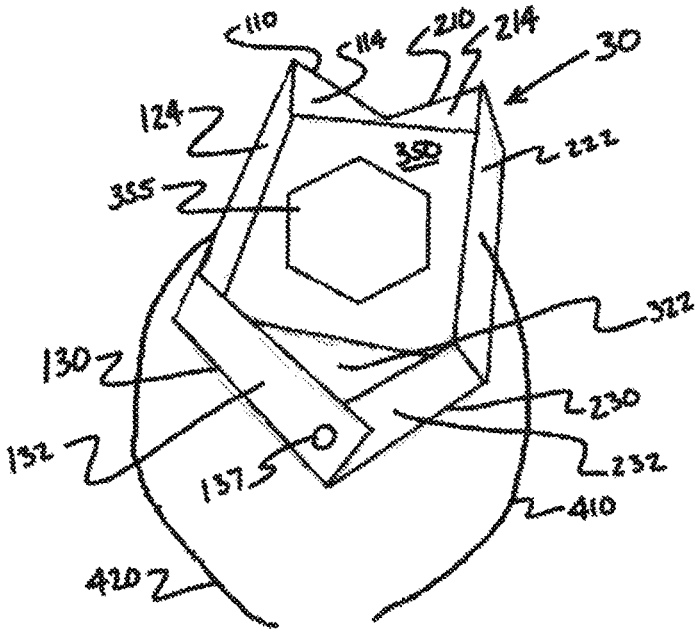
FIG. 9 is a perspective view of an accessory according to one aspect of the invention.
Figure 10:
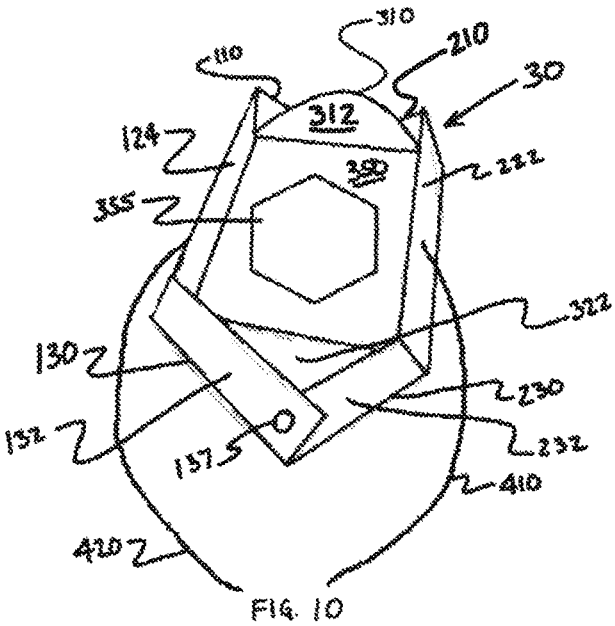
FIG. 10 is another perspective view of an accessory according to one aspect of the invention.

Referring now to FIGS. 8, 9, and 10, an exemplary process by which greeting card 20 or base pattern 10 can be converted into an accessory 30, such as a hat, is described. This process is by way of example only and does not limit application of the present invention. Referring to FIG. 8, brims 100 and 200 are folded outward from surface 350. First brim flap 110 and second brim flap 130 are typically then folded outward from surface 124. Likewise, first brim flap 210 and second brim flap 230 are typically folded outward from surface 224. First lid 310 and second 320 are then typically folded such that each is positioned in a direction generally orthogonal to surface 352. Brim central portions 120 and 220 are then positioned such that each is extended in a direction generally orthogonal to surface 350.

Referring to FIG. 9, brim flaps 130 and 230 are typically releasably affixed to surface 322 of lid 320 using fasteners 135, 137, 235, 237, and 315. Likewise, brim flaps 110 and 210 are typically releasably affixed to surface 312 of lid 310 using fasteners 115, 117, 215, 217, and 325. In one aspect, fasteners 115, 117, 215, 217, 135, 137, 215, 217, 235, 237, 315, and 325 can be hook and pile fastener tape (commonly known as Velcro®), but any other suitable materials for releasably affixing flaps 130 and 230 to lid 320 can be used. Such other materials include, without limitation, snaps, buttons, tape, molding glue, and rubber glue. In other aspects, fasteners 115, 117, 215, 217, 135, 137, 215, 217, 235, 237, 315, and 325 can be slats that are cut into the surface of brim flaps 110, 130, 210, and 230 and lids 310 and 320.

Still referring to FIG. 9, a wide variety of decorations 355 can be positioned on surface 350. Such decorations can include without limitation bows, ribbons, flowers, netting, tooling, feathers and gemstones.

In another aspect of the invention, the shape and geometry of the present invention is typically selected such that brims 100 and 200 will extend in a direction generally orthogonal to surface 350 when brim flaps 130 and 230 are releasably affixed to lid 320 and brim flaps 110 and 210 are releasably affixed to lid 310. In yet another aspect, the shape and geometry of the present invention is typically selected such that lids 310 and 320 will extend in a direction generally orthogonal to surface 352 when brim flaps 130 and 230 are releasably affixed to lid 320 and brim flaps 110 and 210 are releasably affixed to lid 310. Other shapes and geometries can be selected to adjust the angles at which brims 100 and 200 extend from surface 350 and to adjust the angles at which lids 310 and 320 extend from surface 352.

Referring to FIG. 10, in another aspect of the invention, lid 310 can be folded to extend in a direction general orthogonal to surface 350 while lid 320 is folded to extend in a direction generally orthogonal to surface 352. Here, brim flaps 130 and 230 are releasably affixed to lid 320 at surface 322 and brim flaps 110 and 210 are releasably affixed to lid 310 at surface 314.

Once configured as shown in FIG. 9 or 10, accessory 30 can typically be worn on a person's head in a manner similar to that of wearing a conventional hat. Hat 30 is typically oriented such that lid 320 is positioned proximate the forehead of the person wearing hat 30. Alternatively, hat 30 can be positioned as desired upon a person's head, such as positioning lid 310 proximate the wearer's forehead. In other aspect, support strings 410 and 420 can optionally be affixed to brims 100 and 200 for use in securing hat 30 to the wearer. In this aspect, strings 410 and 420 would typically tie underneath the chin of the wearer.

In another aspect, card 20 will typically be packaged in a clear plastic envelope for display to consumers. Other suitable forms of packaging can likewise be used.

All patents, patent publications, and peer-reviewed publications (i.e., "references") cited herein are expressly incorporated by reference to the same extent as if each individual reference were specifically and individually indicated as being incorporated by reference. In case of conflict between the present disclosure and the incorporated references, the present disclosure controls.

It is understood that the invention is not confined to the particular construction and arrangement of parts herein illustrated and described, but embraces such modified forms thereof as come within the scope of the claims.

What is claimed is:

1. A convertible greeting card, comprising:

a central body having a first surface and a second surface disposed opposite the first surface;

a first lid disposed at a first end of the central body and a second lid disposed at a second end of the central body;

a first brim disposed on a first side of the central body; and a second brim disposed on a second side of the central body, wherein the first lid is folded to extend in a direction generally orthogonal to one of the first surface of the central body and second surface of the central body, wherein the second lid is folded to extend in a direction generally orthogonal to one of the first surface of the central body and the second surface of the central body, wherein the first brim is folded to extend in a direction generally orthogonal to the first surface of the central body, wherein the second brim is folded to extend in a direction generally orthogonal to the first surface of the central body, wherein a first brim flap of the first brim and a first brim flap of the second brim are affixed to one another at a position below the first and second surfaces of the central body, and wherein a second brim flap of the first brim and a second brim flap of the second brim are affixed to one another at a position below the first and second surfaces of the central body.

2. The greeting card of claim 1, wherein the first brim is oriented in a direction generally opposite the direction of one or more of the first lid and the second lid.

3. The greeting card of claim 1, wherein the second brim is oriented in a direction generally opposite the direction of one or more of the first lid and the second lid.

4. The convertible greeting card of claim 1, further comprising a message disposed on the second surface of the central body.

5. The convertible greeting card of claim 1, further comprising a decoration disposed on one or more of the first surface of the central body and the second surface of the central body.

6. The convertible greeting card of claim 5, wherein the decoration is a flower.

7. The convertible greeting card of claim 5, wherein the decoration is a bow.

8. A method for converting a greeting card into an accessory, comprising:

folding a first lid on a first end of a central body in a direction generally orthogonal to one of a first surface of the central body and a second surface of the central body;

folding a second lid on a second end of the central body in a direction generally orthogonal to one of the first surface of the central body and the second surface of the central body;

folding a first brim disposed on a first side of the central body in a direction generally orthogonal to a first surface of the central body, wherein the first surface is generally opposite the second surface of the central body;

folding a second brim disposed on a second side of the central body in a direction generally orthogonal to a first surface of the central body;

affixing a first brim flap of the first brim and first brim flap of the second brim to one another at a position below the first and second surfaces of the central body; and affixing a second brim flap of the first brim and second brim flap of the second brim to one another at a position below the first and second surfaces of the central body.

9. The method of claim 8, further comprising:

disposing a message on the second surface of the central body.

10. The method of claim 8, further comprising:

disposing a decoration on one or more of the first surface of the central body and the second surface of the central body.

* * * * *